United States Patent [19]

O'Connor

[11] Patent Number: 4,549,364

[45] Date of Patent: Oct. 29, 1985

[54] APPARATUS AND METHOD FOR MAKING SNOW ROADS

[75] Inventor: Patrick O'Connor, Dryden, Mich.

[73] Assignee: Thermal Power Corporation, Almont, Mich.

[21] Appl. No.: 665,288

[22] Filed: Oct. 26, 1984

[51] Int. Cl.[4] ..... E01H 5/00

[52] U.S. Cl. ..... 37/197; 37/228; 404/77; 404/79; 404/102

[58] Field of Search ..... 37/197, 225, 226, 227, 37/228–229; 404/17, 83, 71–72, 75, 77, 79, 90–95, 102, 101, 114, 118; 405/130, 129

[56] References Cited

U.S. PATENT DOCUMENTS

| | | | |
|---|---|---|---|
| 1,106,735 | 8/1914 | Schuler | 37/228 |
| 2,255,346 | 9/1941 | Baily | 404/102 |
| 3,094,315 | 6/1963 | Yetter | 404/90 |
| 3,371,586 | 3/1968 | Nikolaev et al. | 404/79 |
| 3,508,475 | 4/1970 | Smith | 404/102 |
| 3,818,711 | 6/1974 | Condo et al. | 405/129 |
| 3,986,783 | 10/1976 | Rowley et al. | 404/95 |
| 4,071,966 | 2/1978 | Cohen | 37/228 |
| 4,440,520 | 4/1984 | Fisher | 404/72 |
| 4,473,320 | 9/1984 | Register | 404/75 |

FOREIGN PATENT DOCUMENTS

| | | | |
|---|---|---|---|
| 734334 | 5/1980 | U.S.S.R. | 404/95 |

*Primary Examiner*—E. H. Eickholt

*Attorney, Agent, or Firm*—Gifford, VanOphem, Sheridan & Sprinkle

[57] ABSTRACT

A method for laying a snow road or an airplane runway on a snow or ice covered surface includes the removal of a predetermined and relatively small portion of the snow or ice surface, which is melted to water and mixed with the snow or ice remaining on the snow surface. The mixture of water and snow or ice is leveled so as to form a road surface when the mixture freezes. Preferably, the snow remaining on the surface is mechanically worked with a rototiller, while the melted snow is injected into the snow being worked. The method is particularly advantageous in that it can be carried out without requiring melting of all the snow necessary to form the snow road, or requiring the addition of any water from an external source, other than the portion of snow removed from the snow surface. An apparatus for performing the method is also described.

18 Claims, 2 Drawing Figures

APPARATUS AND METHOD FOR MAKING SNOW ROADS

BACKGROUND OF THE INVENTION

I. Field of the Invention

The present invention is directed to road building equipment and more particularly to equipment to be used in the construction of snow roads and airplane runways.

II. Description of the Prior Art

The exploration and development of the resources of the polar and subpolar areas of the planet are intended to enhance the quality of mankind's existence. Not surprisingly, problems have arisen on account of this activity. One such problem is the difficulty of travel between isolated locations separated by terrain covered with ice and snow. While specialized transport devices are known, their design and manufacture result in a not inconsiderable cost. Part of this cost is the lack of utility of these transport devices in areas which are not covered by ice and snow. The snowmobile is typical of such devices.

Roads constructed from frozen snow or ice, generically referred to as "snow roads", have been offered as a solution. A snow road generally consists of a layer of snow over which water has been applied, which is then compacted and allowed to freeze. The term will be used throughout this application to refer not only to roads but to airplane runways as well. This results ideally in a hard and stable surface suitable for conventional vehicular travel. The problems of clearing deep ice and snow from conventional road or runways, and of the need and expense for specialized vehicle design and construction, are thereby avoided in part.

While several devices and methods for making snow roads are known, they generally have the drawbacks of complicated construction or inefficient operation. One problem encountered with the making of snow roads is that the snow in the polar and subpolar regions is very dry, that is, the snow posseses little water in a fluid or irregularly crystallized state, which would aid in the compacting of snow into a uniform surface. This "dry" snow is often powdery in direct contrast to the "wet", well-packing snow so often used by children for making snow balls and snow men.

Because the dryness of the polar snow causes it to have poor compaction, conventional equipment and methods for the manufacture of snow roads usually involve partially melting the snow and ice which will, when frozen, form the road surface. This partial melting can occur in several ways. Heat can be directly applied to the snow or ice surface to melt it, thereby making the surface more compactable. Alternatively, the snow to be compacted can be lifted from the intended road surface, partly melted by a heater, and returned to the surface for compaction.

Each of these, however, is inefficient in its use of energy. The direct application of heat to the snow and ice often results in the unnecessary release of substantial amounts of heat to the surrounding air, rather than being absorbed by the ice and snow. Any irregularities in the density of the ice or snow can result in gross irregularities in the level of the road surface on compaction. Of course, the lifting of a significant quantity of snow into a vehicle for partial melting results in the wasted effort of lifting that portion of snow and ice which will remain frozen.

Prior to the present invention it has not been possible to construct a snow road with sufficient uniform density to assure safe travel and which could be safely used as a landing strip for aircraft.

SUMMARY OF THE PRESENT INVENTION

According to the present invention, these and other problems are overcome by providing a method and apparatus which maximize the efficiency with which heat is employed to melt the snow and ice, while allowing a road surface of superior uniformity to be laid. The present invention first includes a method for laying a snow road on a snow surface. Throughout this disclosure, the phrase "snow surface" is used to generically describe any portion of terrain which is partly or completely covered by snow and/or ice.

The method according to the present invention includes the improvement of removing only a predetermined portion of the snow surface, in an amount just sufficient to allow uniform compaction of the snow remaining on the snow surface when the removed snow is melted and reapplied to the surface. The snow so removed is melted to water, and mixed with the snow remaining on the snow surface. The mixture of water melted from the removed snow and the snow remaining on the snow surface is leveled and allowed to freeze, whereby the mixture forms the road surface. Preferably, the mixing step comprises the working of the snow remaining on the snow surface with a rototiller, while simultaneously applying the water from the melted snow to the snow remaining on the snow surface. Advantageously, the method can be characterised in that the only source of water for mixing with the snow remaining on the snow surface is water melted from the snow removed. This achieves the advantage that the process can be carried out with a single device, one which does not require a large reservoir of water to be added to the relatively dry snow.

The present invention also includes an apparatus for carrying out this method. The apparatus comprises a support means or a frame moveable over a snow surface, and means on the frame for removing a portion of the snow over which the snow is moved, while leaving a second portion of the snow in place. The apparatus also includes a means on the frame for melting the removed snow to water, and means on the frame behind the snow removing means for mixing this water with the portion of snow left in place. Finally, the apparatus comprises means attached to the frame for forming the mixture of water and snow into a road surface.

Preferably, the apparatus comprises a vehicle including a conveyor for removing the portion of snow to be melted and for delivering the snow to a melting tank. A heating unit, is immersed in the contents of the tank in order to maximize the efficiency of heat to be transferred to the contents. The snow remaining on the snow surface is worked by a rototiller carried on the bottom of the vehicle frame, and water from the tank is injected into the snow being worked. The road forming means comprises a vibratory screed and slip form for creating a uniform surface from the mixture of water and worked snow.

BRIEF DESCRIPTION OF THE DRAWING

A better understanding of the present invention will be had upon reference to the following detailed description, when read in conjunction with the accompanying drawing, wherein like reference characters refer to like parts throughout the views, and in which.

DETAILED DESCRIPTION OF THE PREFERRED EMBODIMENT OF THE PRESENT INVENTION

Figure 1:
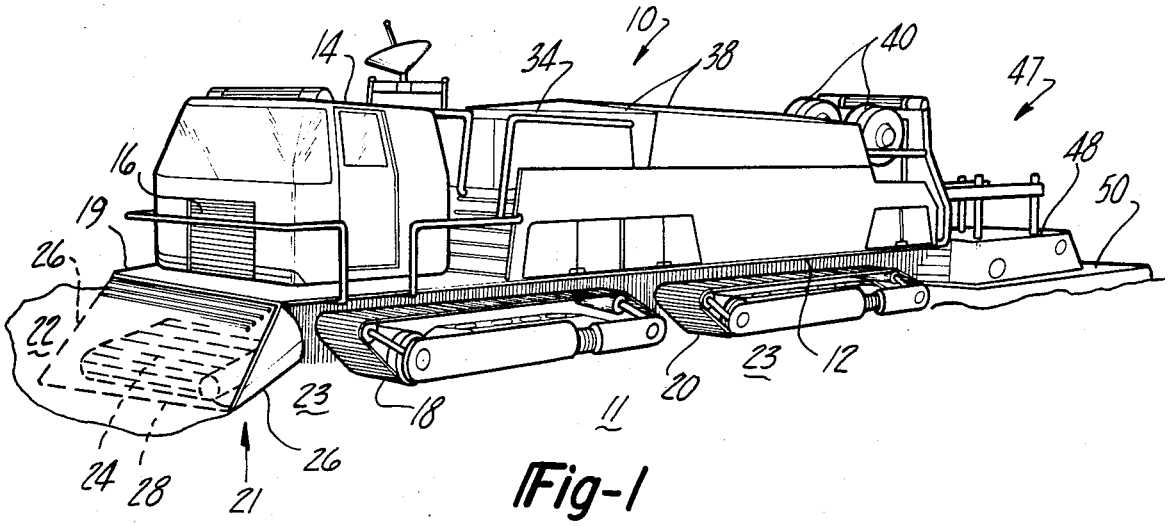
FIG. 1 is a perspective view of the preferred embodiment of the present invention.
Figure 2:
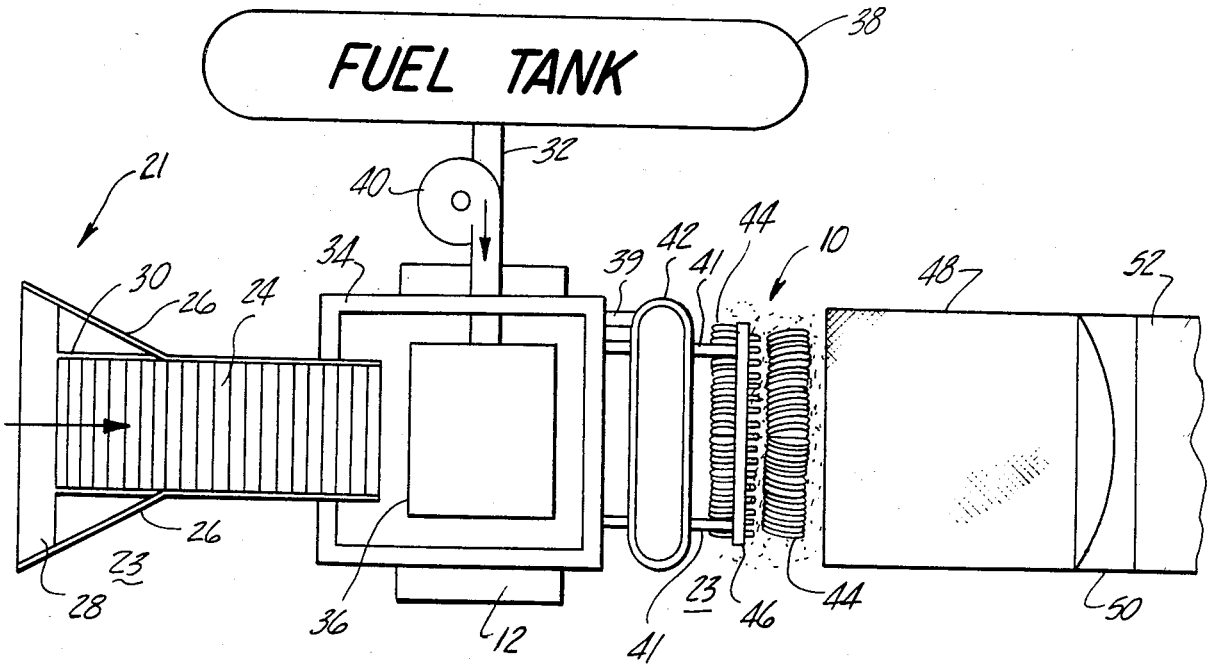
FIG. 2 is a top schematic view of the preferred embodiment of the present invention.

With reference now to FIGS. 1 and 2, an apparatus incorporating the present invention is thereshown and comprises a vehicle 10 including a support means or a frame 12 which is moveable over a snow surface 11 (FIG. 1). The vehicle 10 includes a cab 14 for the driver and an engine compartment 16 for housing the prime mover (not shown) of the vehicle 10, attached to the frame 12. A pair of front drive tracks 18 and rear drive tracks 20 are disposed on the sides of the frame 12, for moving the frame 12 in a position above the snow surface 11.

As best seen in FIG. 1 a means 21 is mounted on a front end 19 of the frame 12 for removing a first, upper portion 22 of the snow surface, the upper snow portion 22 being removed only to a predetermined depth forward of the vehicle 10, depending upon the moisture and density of a lower portion 23 of the snow which remains in place on the snow surface 11. The snow removing means 21 comprises a conveyor 24 for transporting the upper snow portion 22 into the interior of the vehicle 10. The snow removing means 21 further comprises a pair of angled side walls 26 for windrowing the upper snow portion 22 for introduction onto the conveyor 24. Finally, the snow removing means 21 includes a bottom plate 28 mounted at the lower end 30 (FIG. 2) of the conveyor 24, for precisely controlling the depth of the upper snow portion 22 which is removed.

The upper snow portion 22 which is removed by the snow removing means 21 is carried by the conveyor 24 upwardly to be introduced into a tank 34 mounted interiorly of the vehicle 10, behind the snow removing means 21. A heater unit 36 (FIG. 2) is disposed inside the tank and preferably is immersed in the contents of the tank 34. The heating unit 36 employs jet fuel as a fuel, the jet fuel being stored in a pair of fuel tanks 38 carried on the frame 12 behind the tank 34. A pair of blowers 40 (FIG. 1) provide the air to be mixed with the fuel drawn from the fuel tank 38 via a conduit 32 with air, and supply the fuel-air mixture to the heater unit 36 for ignition and warming of the contents of the tank 34. A smaller, holding tank 42 is disposed on the frame 12 between the tank 34 and the fuel tank 38, in order to hold any overflow from the tank 34 passing through an over flow line 39. The holding tank 42 thus provides a small, self-contained reservoir in case a particularly dry or nearly bare patch of snow surface 11 is encountered.

Still referring to FIG. 2 a pair of variable depth rototillers 44 are carried beneath the frame 12 for working the unremoved and undisturbed lower snow portion 23 beneath the vehicle 10. A plurality of sprayers 46 are carried on the frame adjacent to the variable depth rototillers 44 for applying water from the tank 34 (supplied by a pair of sprayer feed lines 41) to the lower snow portion 23 being worked by the rototillers 44. Preferably, the sprayers 46 are positioned so as to inject water from the tank 34 into the snow between the blades of the rototiller 44. The variable depth rototillers 44 thus provide a means for working the unremoved snow 23.

The tank 34 and the heater unit 36 together comprise a means for melting the upper snow portion 22 removed by the snow removing means 21.

As shown in FIG. 1 the vehicle 10 also includes a means 47 attached to the frame 12 for leveling the mixture of snow and water worked by the rototiller 44, consisting of the water from the upper snow portion 22 and the unremoved lower snow portion 23. Preferably, the leveling means 47 comprises a vibratory screed 48 drawn by the motion of the frame 12, and a slip form 50 affixed to the rear of the vibratory screed 48.

The method according to the present invention for laying down a snow road on a snow surface is most advantageously carried out by the vehicle 10 described above. The vehicle 10 is driven on a snow surface 11 at a speed of approximately 2 miles per hour, more or less, depending upon the resistance of the snow surface 11 to working, and to the environmental conditions. The snow surface 11, and in particular the lower snow portion 23, is examined in order to determine the amount or depth of the upper snow portion 22 which will have to be removed and melted in order to achieve the desired compaction of the lower snow portion 23. The bottom level plate 28 of the conveyor 24 is set to the depth so determined, and the vehicle 10 is moved in a forward direction so as to move the frame 12 over the snow surface 11. The side walls 26 and bottom level plate 28 will windrow the relatively small upper snow portion 22 and feed it to the conveyor 24. The conveyor 24 carries the upper snow portion 22 so removed to the tank 34, for melting and warming by the heater unit 36 and by the heated water already in the tank 34. The fuel tanks 38 and blower 40 are employed in their conventional fashion to actuate the heater unit 36. Advantageously, the fuel tanks 38 can also serve as the fuel source for the prime mover of the vehicle 10.

After the removal of the upper snow portion 22, the lower, undisturbed snow portion 23 beneath the vehicle is worked by the variable depth rototillers 44. The sprayers 46 inject water from the tank 34 into the snow being worked. The rototillers 44 and sprayers 46 thereby mix the water with the lower snow portion 23 remaining on the snow surface 11. The continued motion of the vehicle 10 draws the vibratory screed 48 and the slip form 50 over the worked mixture of water and snow, so as to form a level and uniform road surface 52 rearwardly of the vehicle 10.

It is preferred that the only source of water for mixture with the lower snow portion 23 is the upper snow portion 22 removed from the snow surface 11. If, however, small patches or areas of low snow density are encountered, water can additionally be drawn from the holding tank 42 in order to ensure the uniformity of the snow road laid by the vehicle 10. Conveniently, the tank 34 maintains a reservoir of warm water, so that the upper snow portion 22 fed to the tank 34 is melted quickly, thereby allowing rapid travel of the vehicle 10. If the rototillers 44, screed 48 and slip form 50 are employed which are 12 feet wide, and the vehicle is moved at a rate of two miles per hour the heater disposed in the tank 34 will melt enough water to allow a sixteen inch deep by 12 foot wide road bed to be laid.

While the present invention has been described as being suitable for producing snow roads it should be understood that it is especially useful for producing landing strips for aircraft as well.

Having described my invention, however, many modifications thereto will become apparent to those skilled in the art to which it pertains, without deviation from the spirit of the present invention, as defined by the scope of the appended claims. For example, other well known snow removing, melting and working means can be substituted for the corresponding means described herein. The same is true for the sprayer which applies or injects water into the snow worked by the snow working means. Finally, the snow leveling means can include a heater, ski guide means, or other similar devices for controlling the level of the road formed by the vehicle as are well known. Of course, the vehicle can be hinged or reticulated in the fashion of other lengthy vehicles.

I claim:

1. A method for laying a snow road on a snow surface, comprising the steps of:

delivering a predetermined amount of snow;

melting the snow so delivered to water;

mechanically working the snow remaining on the snow surface;

mechanically mixing said water with the mechanically worked snow remaining on the snow surface; and leveling the mixture of water and snow so formed;

allowing said mixture to freeze so as to form a road surface.

2. A vehicle for making a snow road rearwardly of said vehicle during the passage of said vehicle over snow, comprising:

a movable frame;

means on said frame for removing a predetermined depth of snow forward of said vehicle;

means on said frame for melting said snow removed by said snow removing means to water;

means beneath and carried by said frame for mechanically working the unremoved snow beneath said frame;

means on said frame adjacent said snow working means for applying said water to the snow worked by said mechanical snow working means;

and means attached to said frame for leveling the snow mechanically worked by said working means and wetted by said water applying means.

3. The invention according to claim 2, and further comprising a motor on said frame.

4. The invention according to claim 2, wherein said snow removing means comprises a conveyor on said frame feeding said removed snow to said snow melting means.

5. The invention according to claim 2, wherein said snow melting means comprises a tank on said frame for containing said removed snow and means attached to said tank for heating the contents of said tank.

6. The invention according to claim 5, wherein said heating means comprises a jet fuel/air premixed heater.

7. The invention according to claim 2, wherein said snow working means comprises a rototiller.

8. The invention according to claim 2, wherein said leveling means comprises a vibratory slip form screed attached to said frame.

9. In combination:

a support means movable over snow;

means on said support means for removing a first portion of the snow over which the support means is moved while leaving a second portion of the snow in place;

means on said support means for melting said first portion of snow to water;

means on said support means behind said snow removing means for mixing said water with said second portion of snow left in place;

and means attached to said support means for forming the mixture of said water and said second portion of snow into a road surface;

wherein said mixing means comprises means beneath said support means for mechanically working said second portion of snow left in place, and means for applying said water to the second portion of snow worked by said mechanical working means.

10. The invention according to claim 1, and further comprising means on said support means for moving said support means over snow.

11. The invention according to claim 10, wherein said support means moving means comprises a motor.

12. The invention according to claim 1, wherein said snow removing means comprises a conveyor on said support means for feeding said first portion of snow to said snow melting means.

13. The invention according to claim 1, wherein said snow melting means comprises a tank on said support means containing said first portion of snow to be melted, and means attached to said tank for heating the contents of said tank.

14. The invention according to claim 1, wherein said melting means comprises a jet fuel/air mixture heater.

15. The invention according to claim 1, wherein said support means is reticulated.

16. The invention according to claim 1, wherein said road surface forming means comprises a vibratory slip form screed attached to said support means.

17. The invention according to claim 1, characterised in that said first portion of snow is the sole source of water mixed with said second portion of snow.

18. The invention according to claim 1, wherein said snow working means comprises a rototiller.

* * * * *